US010714826B2

(12) United States Patent
Peterson

(10) Patent No.: US 10,714,826 B2
(45) Date of Patent: Jul. 14, 2020

(54) ADAPTIVE THINNING OF AN ACTIVE ELECTRONIC SCAN ANTENNA FOR THERMAL MANAGEMENT

(71) Applicant: The Boeing Company, Chicago, IL (US)

(72) Inventor: David Brian Peterson, Seattle, WA (US)

(73) Assignee: THE BOEING COMPANY, Chicago, IL (US)

( * ) Notice: Subject to any disclaimer, the term of this patent is extended or adjusted under 35 U.S.C. 154(b) by 306 days.

(21) Appl. No.: 15/727,429

(22) Filed: Oct. 6, 2017

(65) Prior Publication Data

US 2019/0109378 A1 Apr. 11, 2019

(51) Int. Cl.

| | |
|---|---|
| ***H01Q 3/26*** | (2006.01) |
| ***H01Q 21/00*** | (2006.01) |
| ***H01Q 21/22*** | (2006.01) |

(52) U.S. Cl.

CPC ..... *H01Q 3/2605* (2013.01); *H01Q 3/267* (2013.01); *H01Q 21/00* (2013.01); *H01Q 21/22* (2013.01)

(58) Field of Classification Search

CPC combination set(s) only.
See application file for complete search history.

(56) References Cited

U.S. PATENT DOCUMENTS

| | | | | |
|---|---|---|---|---|
| 5,225,841 | A | 7/1993 | Krikorian et al. | |
| 6,404,404 | B1 * | 6/2002 | Chen | H01Q 21/0025 343/844 |
| 7,570,209 | B2 | 8/2009 | Shi et al. | |
| 9,568,590 | B1 * | 2/2017 | Haupt | G01S 7/2813 |
| 9,568,950 | B2 | 2/2017 | Christie | |
| 2010/0245179 | A1 * | 9/2010 | Puzella | H01Q 1/02 343/702 |
| 2012/0032876 | A1 * | 2/2012 | Tabe | H04B 1/3838 345/156 |
| 2017/0054208 | A1 * | 2/2017 | Pietila | H01Q 3/24 |

FOREIGN PATENT DOCUMENTS

| | | |
|---|---|---|
| EP | 3121898 | 1/2017 |
| GB | 2542163 | 3/2017 |

OTHER PUBLICATIONS

Extended European Search Report dated Feb. 13, 2019 for European Patent Application No. 18198235.6.
European Examination Report dated Mar. 10, 2020 for European Patent Appln. No. 18198235.6.

* cited by examiner

*Primary Examiner* — Mamadou L Diallo
(74) *Attorney, Agent, or Firm* — Gates & Cooper LLP

(57) ABSTRACT

A system and method for adaptively controlling an active phased array antenna comprising a plurality of elements is disclosed. In one embodiment, the method comprises determining a thermal profile of at least a portion the active phased array antenna, comparing the determined thermal profile with a reference thermal profile and deactivating only a subset of the plurality of elements according to a thinning pattern based at least in part on the comparison between the determined thermal profile and the reference thermal profile. Another embodiment is evidenced by an apparatus performing the foregoing operations.

16 Claims, 14 Drawing Sheets

ADAPTIVE THINNING OF AN ACTIVE ELECTRONIC SCAN ANTENNA FOR THERMAL MANAGEMENT

BACKGROUND

1. Field

The present disclosure relates to systems and methods for the use of active phased array antennas, and in particular to a system and method for adaptively thinning the elements used with active phased array antennas for purposes of thermal management.

2. Description of the Related Art

In recent years, there has been an increased demand for wireless communications services. This increased demand includes the desire for wireless communication services to and from aircraft. Such wireless communications are often implemented with the use of active phased array antennas. Such antennas include a phased array of radiating elements that are individually controlled to change the characteristics of the antenna such as the beam direction, beamwidth, and sidelobes.

In many cases, wireless communications are implemented via satellite communications (SATCOM) and as the airborne SATCOM market moves toward higher data rates and higher frequencies, the power density of the phased array increases, and thermal management becomes increasingly difficult. Liquid cooling of the active phased array antennas is possible, but is more expensive and undesirable. Instead, convection cooling is desirable for airborne applications.

Convection cooling of active phased array antennas is effective when the antenna disposed on a flying aircraft. However, convection cooling is not as effective when the aircraft is on the ground where temperatures are higher and wind speeds are much less. Convection alone is typically insufficient to assure that the thermal profile of the active phased array remains within required limits. As a consequence, the active phased array antenna must be shut down or cooled by auxiliary equipment, such as a ground cart. However, the use of ground carts requires additional equipment, logistics, maintenance, and man-hours.

What is needed is a system and method for operating active phased array antennas in challenging thermal environments. This disclosure describes embodiments of a solution to this need.

SUMMARY

To address the requirements described above, this document discloses a system and method for adaptively controlling an active phased array antenna comprising a plurality of elements. In one embodiment, the method comprises determining a thermal profile of at least a portion the active phased array antenna, comparing the determined thermal profile with a reference thermal profile and deactivating only a subset of the plurality of elements according to a thinning pattern based at least in part on the comparison between the determined thermal profile and the reference thermal profile.

In related embodiments, the determining the thermal profile of the at least the portion of the active phased array antenna includes determining a thermal profile of the at least the portion of the active phased array antenna having a higher thermal profile than other portions of the active phased array antenna; and the thinning pattern is non-uniform throughout the phased array antenna and selected so that the deactivated subset of the plurality of elements are disposed in closer proximity to the at least a portion of the active phased array antenna having a higher thermal profile than other of the plurality of elements.

Other related embodiments include embodiments where the thinning pattern is substantially uniform throughout the active phased array antenna, wherein the thermal profile includes at least one of a thermal density of the at least a portion of the active phased array antenna and a maximum temperature of the at least the portion active phased array antenna, and where the thinning pattern maximizes on-axis equivalent isotropic radiated power (EIRP) subject to a beamwidth constraint and a peak sidelobe constraint or maximizes on-axis equivalent isotropic radiated power (EIRP) spectral density subject to an off-axis equivalent isotropic radiated power (EIRP) spectral density constraint.

Another embodiment is evidenced by an apparatus for adaptively controlling an active phased array antenna comprising a plurality of elements. In this embodiment, the apparatus comprises a thermal profile determining module for determining a thermal profile of at least a portion the active phased array antenna, a comparison module for comparing the determined thermal profile with a reference thermal profile, and a thinning pattern determining module for deactivating only a subset of the plurality of elements according to a thinning pattern based at least in part on the comparison between the determined thermal profile and the reference thermal profile.

Still other embodiments are evidenced by evidenced by an apparatus having means for performing the above operations, including a processor and a communicatively coupled memory storing processor instructions for performing the foregoing operations.

The features, functions, and advantages that have been discussed can be achieved independently in various embodiments of the present invention or may be combined in yet other embodiments, further details of which can be seen with reference to the following description and drawings.

BRIEF DESCRIPTION OF THE DRAWINGS

Referring now to the drawings in which like reference numbers represent corresponding parts throughout.

DESCRIPTION

In the following description, reference is made to the accompanying drawings which form a part hereof, and which is shown, by way of illustration, several embodiments. It is understood that other embodiments may be utilized and structural changes may be made without departing from the scope of the present disclosure.

Overview

As described below, selective thinning of the active phased array antenna is used while the aircraft is on the ground to reduce thermal dissipation and allow continued convection cooled operation while maintaining a reduced but useable antenna performance.

Other antenna thinning paradigms are known, such that that which is described in U.S. Pat. No. 9,568,590, (hereinafter, the '590 patent) which is hereby incorporated by reference herein. However, the '590 patent discloses a system which performs dynamic thinning to achieve a target signal to noise ratio, and chooses thinning patterns to select sidelobe characteristics that minimize interference by changing the nulls and peaks in the sidelobes. The result is antenna patterns that are not suitable for reducing the thermal profile of a phased array antenna, as the optimized constraints result areas with densely disposed radiating elements, such as those shown in FIGS. 4A and 4B. The system described herein is optimized to reduce the thermal profile of the phased array antenna while maintaining adequate main beam performance and acceptable interference levels. Typically, this results in the radiating elements being randomly disposed on the phased array antenna, simultaneously providing acceptable main beam beamwidth and reduced heat.

Communications System

Figure 1:
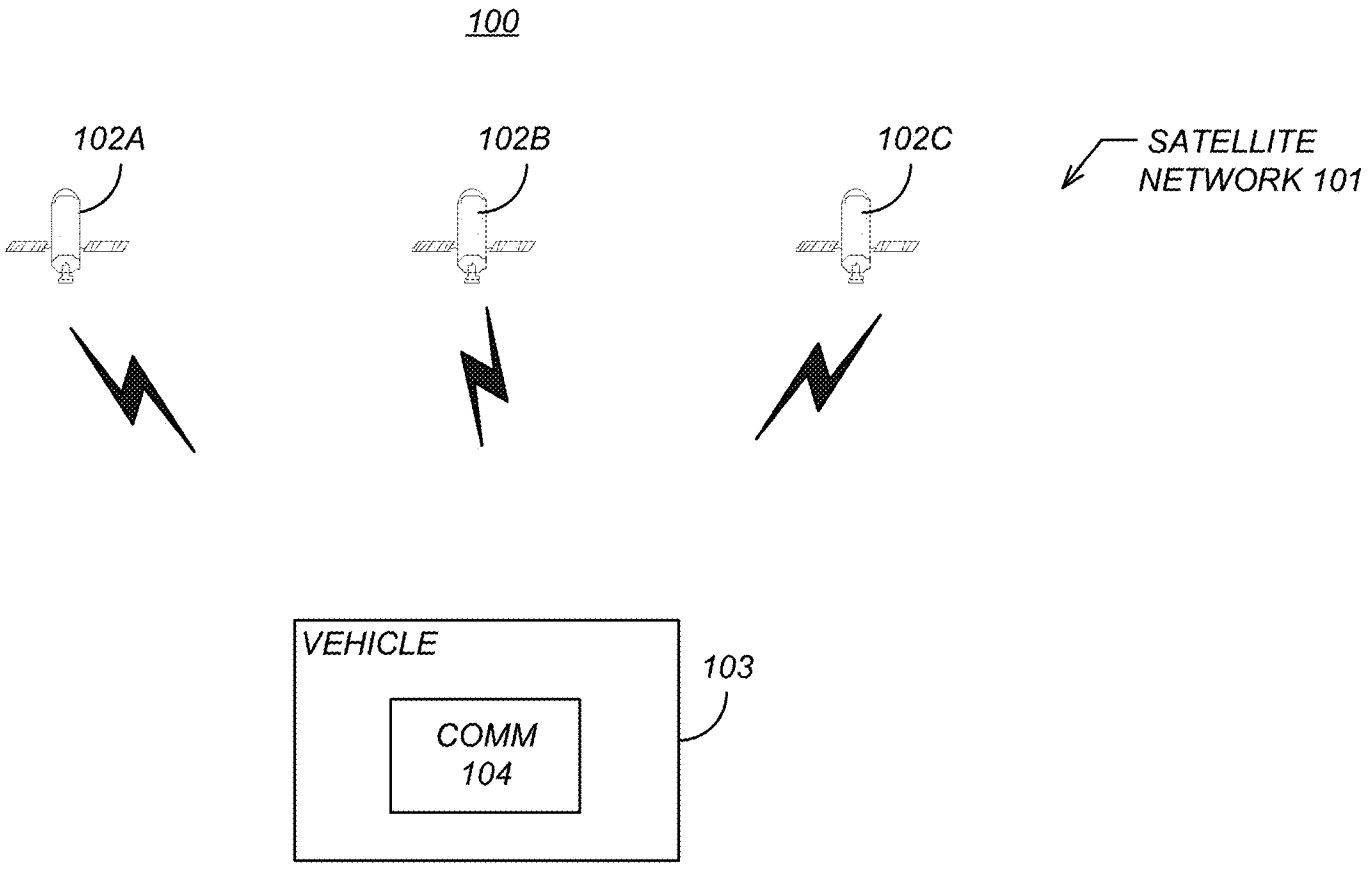
FIG. 1 is a diagram showing one embodiment of an exemplary communications system, according to one embodiment.

FIG. 1 is a diagram showing one embodiment of an exemplary communications system 100. The communications system 100 comprises a satellite network 101 that includes one or more satellites 102A-102N (hereinafter alternatively referred to as satellite(s) 102), communicatively coupled to one or more communication stations 104. In one embodiment, the communications station 104 is disposed on a vehicle such as an aircraft (pictured) 103, a ship, an automobile, bus, or truck. The communication station 104 may also be stationary and terrestrially based.

The satellite network 101 may also include a ground station (not pictured) for transmitting and receiving data to and from the satellites 102. The satellite network 101 may also interface to one or more other satellite, terrestrial and/or airborne networks (not shown), for example, a cellular or personal communications systems (PCS) network, wireless local area networks (WLANs), personal area networks (PANs), or other networks. The communication station 104 may also operate with the other satellite, terrestrial and/or airborne networks.

Satellite networks 101 have the advantage of offering coverage of broad terrestrial regions. That is particularly the case with satellites 102 disposed in geosynchronous or geostationary orbits, but to a lesser extent, it is also the case with satellites 102 deployed in mid-earth orbits (MEO) or low-earth orbits (LEO). Satellite networks 101 offer an alternative option to terrestrially based communication networks, and can also augment such terrestrially-based networks to overcome congestion. Similar advantages may be obtained from airborne communication networks (e.g. a network of air vehicles having on board communications systems).

Communications Station

Figure 2A:
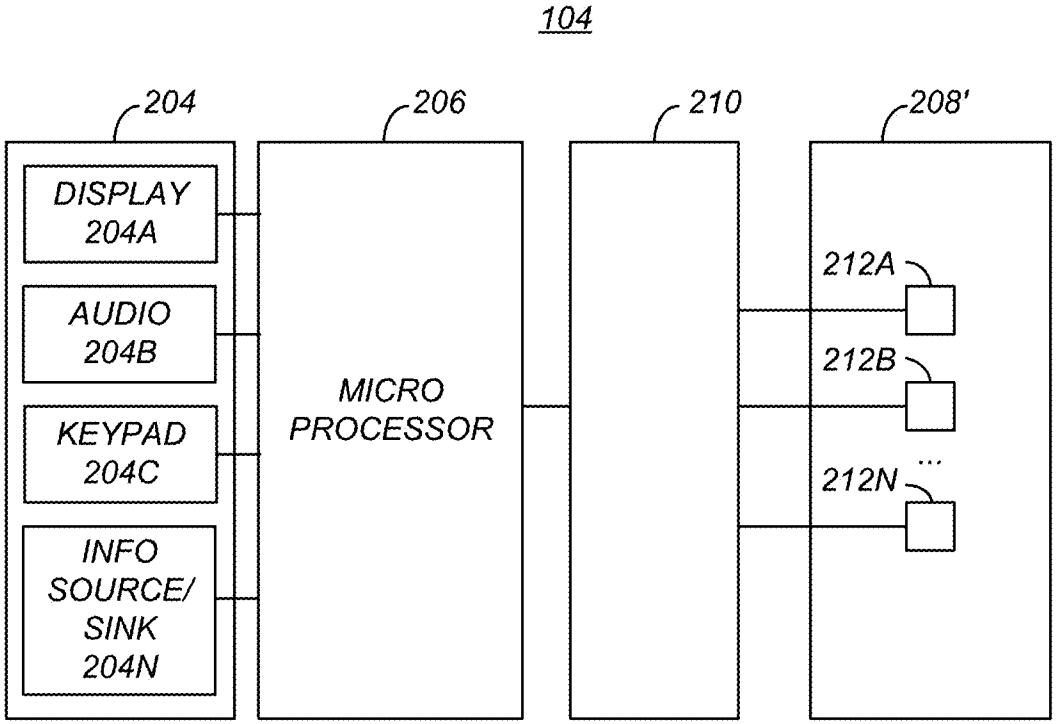
FIGS. 2A-2B illustrate embodiments of an exemplary communications station.
Figure 2B:
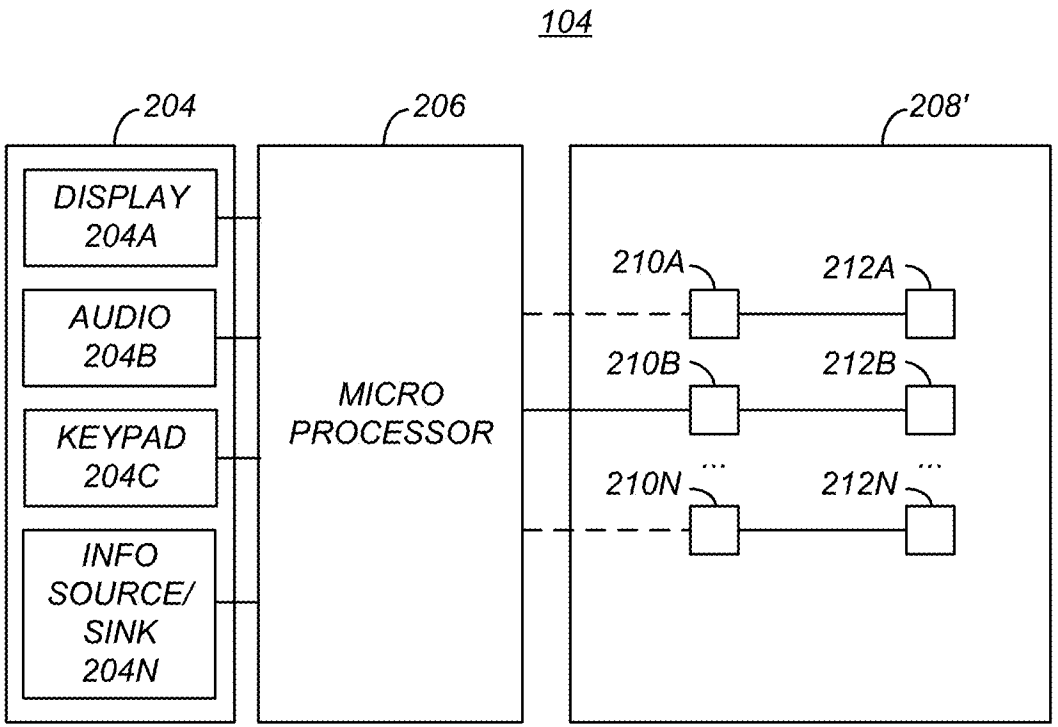

FIGS. 2A-2B illustrate embodiments of an exemplary communications station 104. Referring first to FIG. 2A, the communication system comprises a microprocessor 200 communicatively coupled to one or more I/O devices 204 and an antenna such as a phased array antenna 208. The microprocessor 206 controls the operations of the communication station 104 by accepting commands and data from the I/O devices, processing the commands, and providing an output signal and/or commands to an antenna such as a phased array antenna 208. The microprocessor 206 also optionally provides output data (for example processed signals received by the antenna to the I/O devices 204.

The I/O devices 204 may include, for example, a display 204A, loudspeaker and/or microphone 204B and keypad 204C and/or other information source/sink 204N for inputting and outputting data as directed by the microprocessor 200.

FIG. 2A illustrates an exemplary communications station 104 having a conventional phased array antenna 208. The phased array antenna 208 comprises a plurality of radiating elements 212A-212N (hereinafter, alternatively referred to as radiating elements 212), each of which is communicatively coupled to a transmitter, a receiver or a transceiver 210 which both transmits and receives signals.

In a transmit mode, the transceiver 210 receives input signals from the microprocessor 206 or another source, processes these signals, and provides the processed signals to the radiating elements 212. The radiating elements 212 convert the processed signals to an electromagnetic wave, and the combined electromagnetic waves from the combined radiating elements produces a transmitted electromagnetic wave of desired characteristics such as direction, beamwidth, and sidelobe magnitude. In a receive mode, the radiating elements 212 each receive an electromagnetic wave from another element in the communication system 100, and convert the electromagnetic wave into a signal. The signal from each element is provided to the transceiver, which processes the signals to generate a received signal that is provided to the microprocessor. The microprocessor further processes this signal and provides the further processed signal to one or more of the I/O devices 204.

Multiple transceivers 210 may be used. For example, a satellite transceiver may be used for satellite network 101 communications, a cellular/PCS transceiver may be used for cellular/PCS communications, and a WLAN/PAN transceiver may be used for WLAN/PAN communications. Or, a single transceiver 210 may be used for all such communications.

FIG. 2B illustrates an exemplary communications station 104 wherein the phased array antenna 208 comprises an active phased array antenna 208'. Unlike the conventional phased array antenna, each radiating element 212A-212N of the active phased array antenna 208' is associated with a dedicated, solid state transceiver module (TRM) 210A-210N that is typically integrated with the radiating element 212A-212N, respectively (and thus, the phased array antenna 208) itself.

The TRMs 210A-210N may comprise satellite-specific TRMs 210 for communicating with the satellite network 101, cellular/PCS TRMs for communicating with a cellular/PCS network and/or WLAN/PAN TRMs for communicating with other WLAN/PAN elements. Or, the same TRMs 210A-210N can be used to transceive information with the satellite network 101, cellular/PCS network and WLAN/PAN elements.

Active Phased Array Antenna

Figure 3:
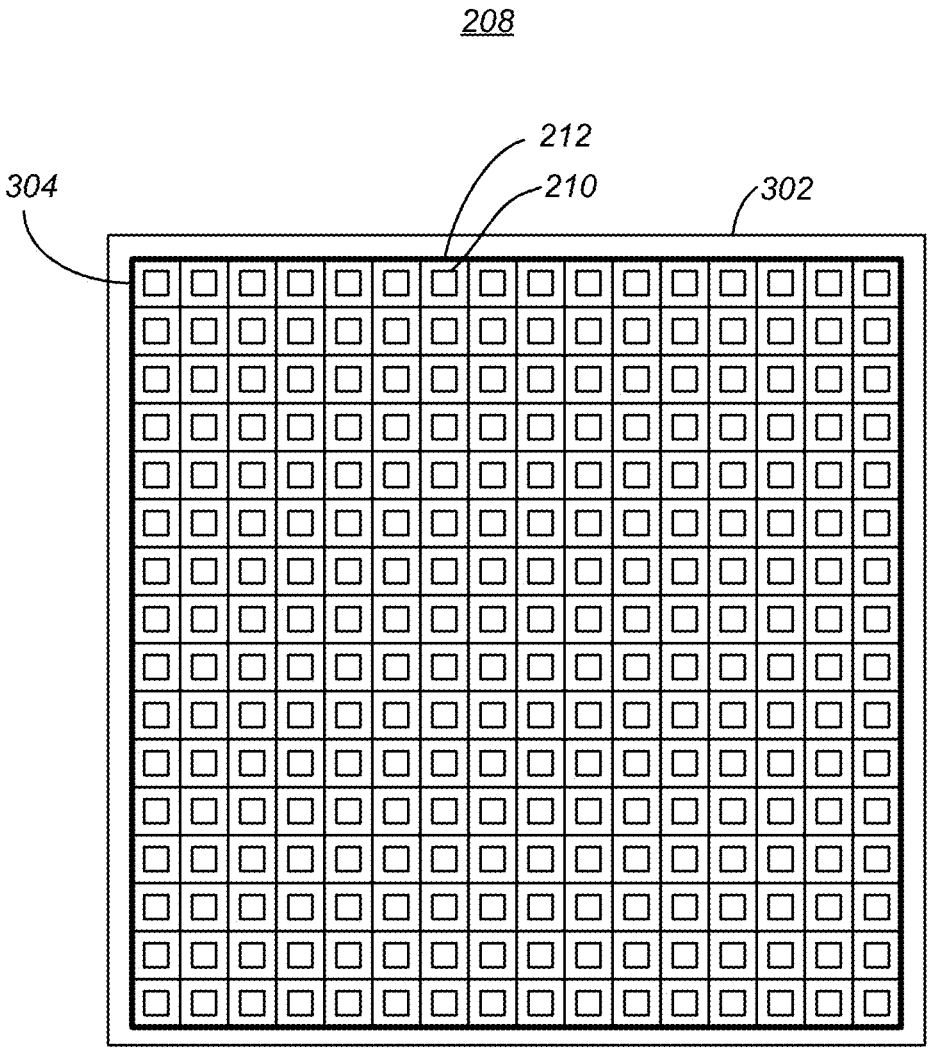
FIG. 3 is a diagram illustrating one embodiment of an active phased array antenna.

FIG. 3 is a diagram illustrating one embodiment of an active phased array antenna 208". The active phased array antenna 208" is comprises an array 304 of the radiating elements 212 formed on a substrate 302. Each radiating element 212 is shown as a square feature, but could comprise a patch, dipole, slot or other type of radiating element 212. The substrate 302 is also shown as a square feature, but could comprise any shape as well. The array 304 of the radiating elements 212 is also shown with a square lattice, but could comprise a triangular or other lattice as well.

The signals provided to each of the TRMs 210' associated with each radiating element 212 (and/or the TRMs 210' themselves) are individually controllable by the microprocessor 200 of the communication station 104, so that the phases and/or amplitudes of signals feeding the radiating elements 212 are varied to create a desired radiation pattern for the active phased array antenna 208". The resulting beams of the desired radiation pattern are formed and then steered by shifting the phase and/or amplitude of the signals feeding each radiating element 212 to provide the desired signal by use of constructive or destructive interference. This allows the microprocessor 200 to beamform the antenna's sensitivity pattern and steer radio waves in the desired direction without physically moving the active phased array antenna 208 itself.

Figure 4A:
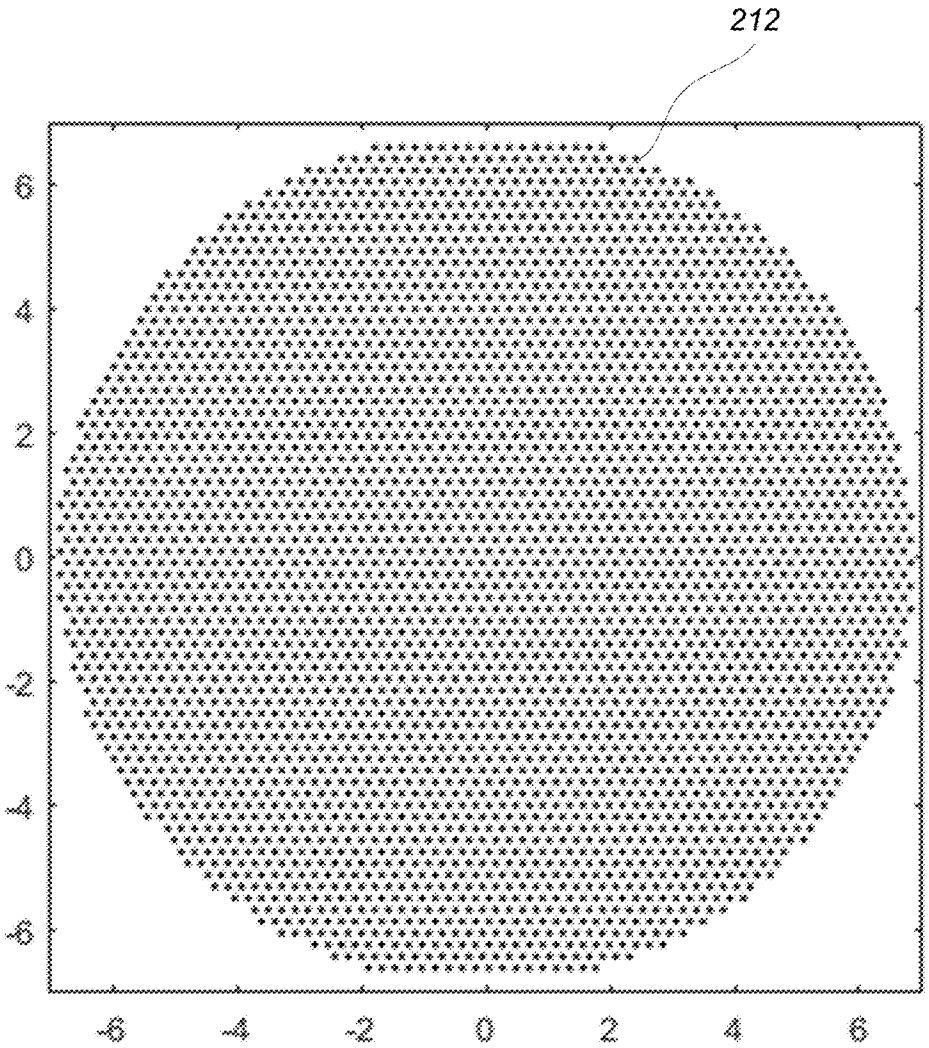
FIGS. 4A and 4B are diagrams illustrating characteristics of an active phased array antenna in which all of the radiating elements are active.
Figure 4B:
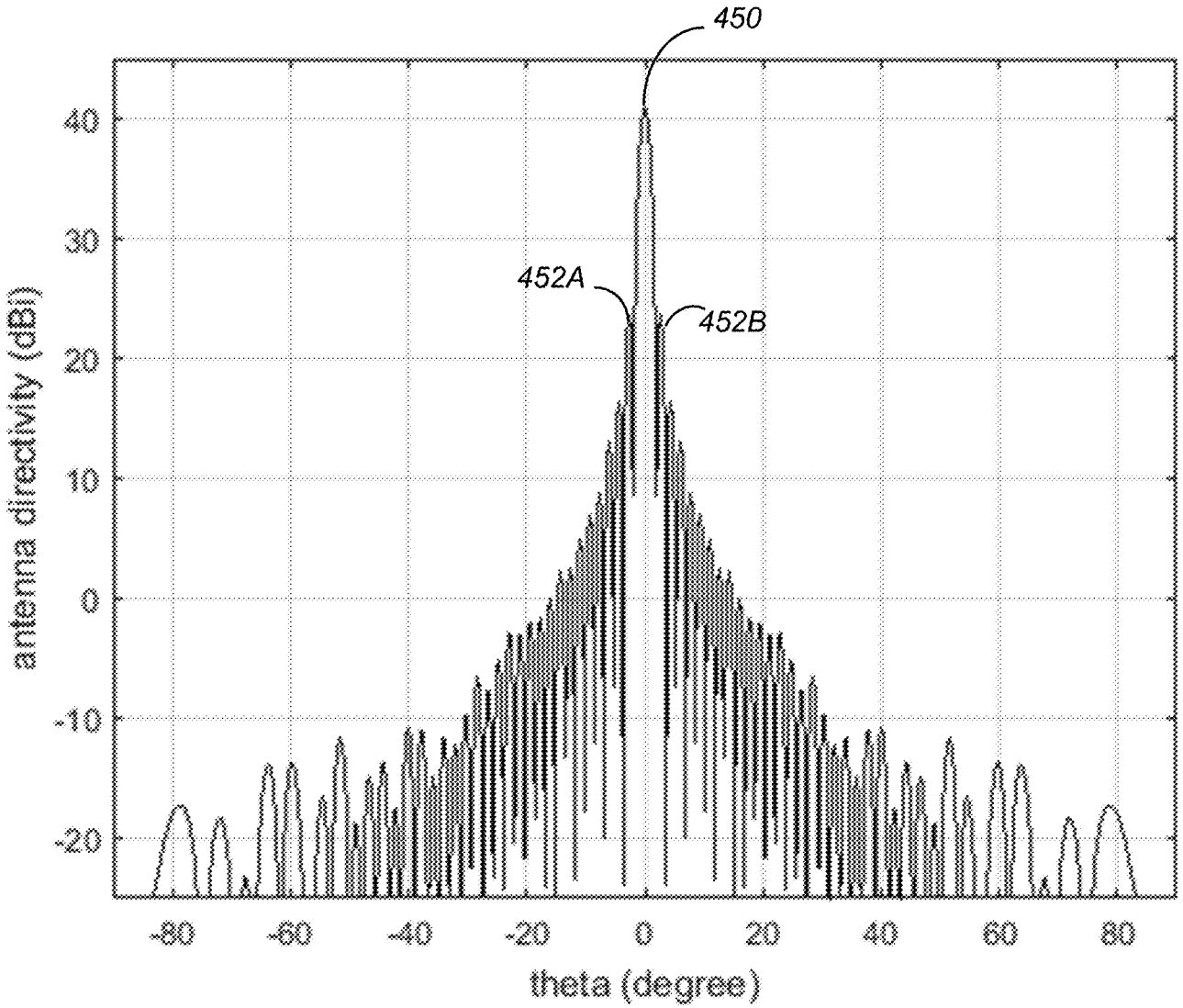

FIGS. 4A and 4B are diagrams illustrating characteristics of an active phased array antenna 208' in which all of the radiating elements 300 (and their associated TRMs 210) are active. In this embodiment, the active phased array antenna 208' is circular in shape, and is approximately 14 inches in diameter.

FIG. 4A depicts a view indicating which of the active phased array antenna radiating elements are active (e.g. emitting an electromagnetic wave). As illustrated there are 3700 radiating elements in the array having a lattice of elements 0.215 inches apart in the horizontal direction and 0.186 inches apart in the vertical direction, with a skew of sixty degrees, and all of the radiating elements 212 are active.

FIG. 4B is a diagram depicting an antenna sensitivity pattern for the active phased array antenna 208" operating with all of the radiating elements 212 in an active state (e.g. as illustrated in FIG. 4A) at 30.25 GHz. Note that a main beam 450 is produced having a 3 dB width (e.g. beamwidth) about 1.7 degrees. Also, note that first sidelobes 452A and 452B adjacent to the main beam 450 are 17 dB below the main beam, and that the attenuation for the remaining sidelobes varies from 24 dB below the main beam to more than 40 dB below the main beam. This antenna sensitivity pattern is indicative of low radiation directed off boresight (where such energy may be problematic for adjacent satellites), as well as a narrow beamwidth of high sensitivity in the main beam 450.

As described above, there is there are some operational conditions in which the use the entire array of radiating elements 212 may result in overheating of the radiating elements 212 or the TRMs 210' associated with those elements. This may occur, for example, if the active phased array antenna 208' is a part of a communication station 104 disposed on an aircraft 103 on the tarmac of an airport. This problem may be ameliorated by turning off or deactivating some of the radiating elements 212 or the TRMs 210' associated with those elements.

Figure 5A:
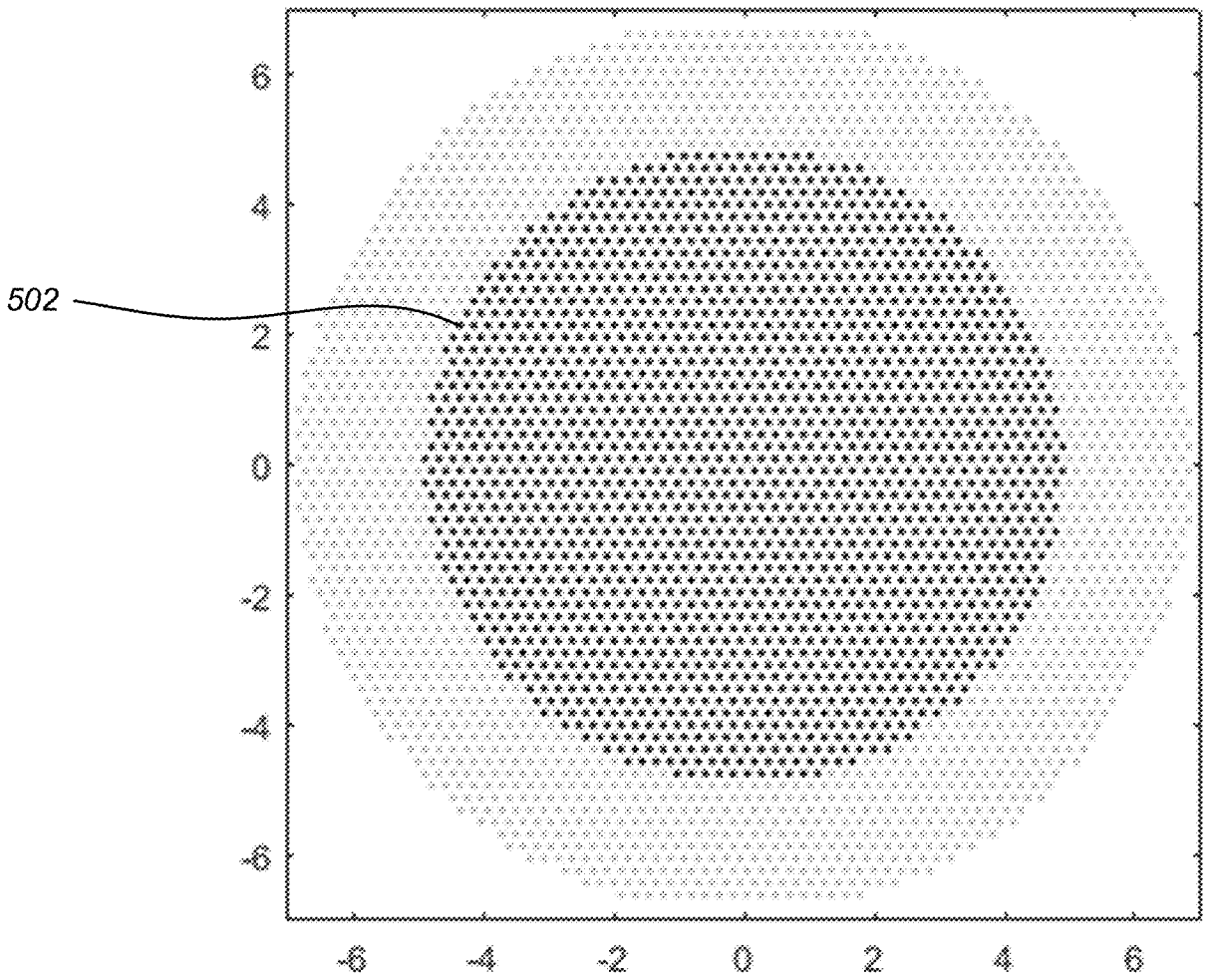
FIGS. 5A and 5B are diagrams illustrating characteristics of an active phased array antenna in which only a subset of the radiating elements are active.
Figure 5B:
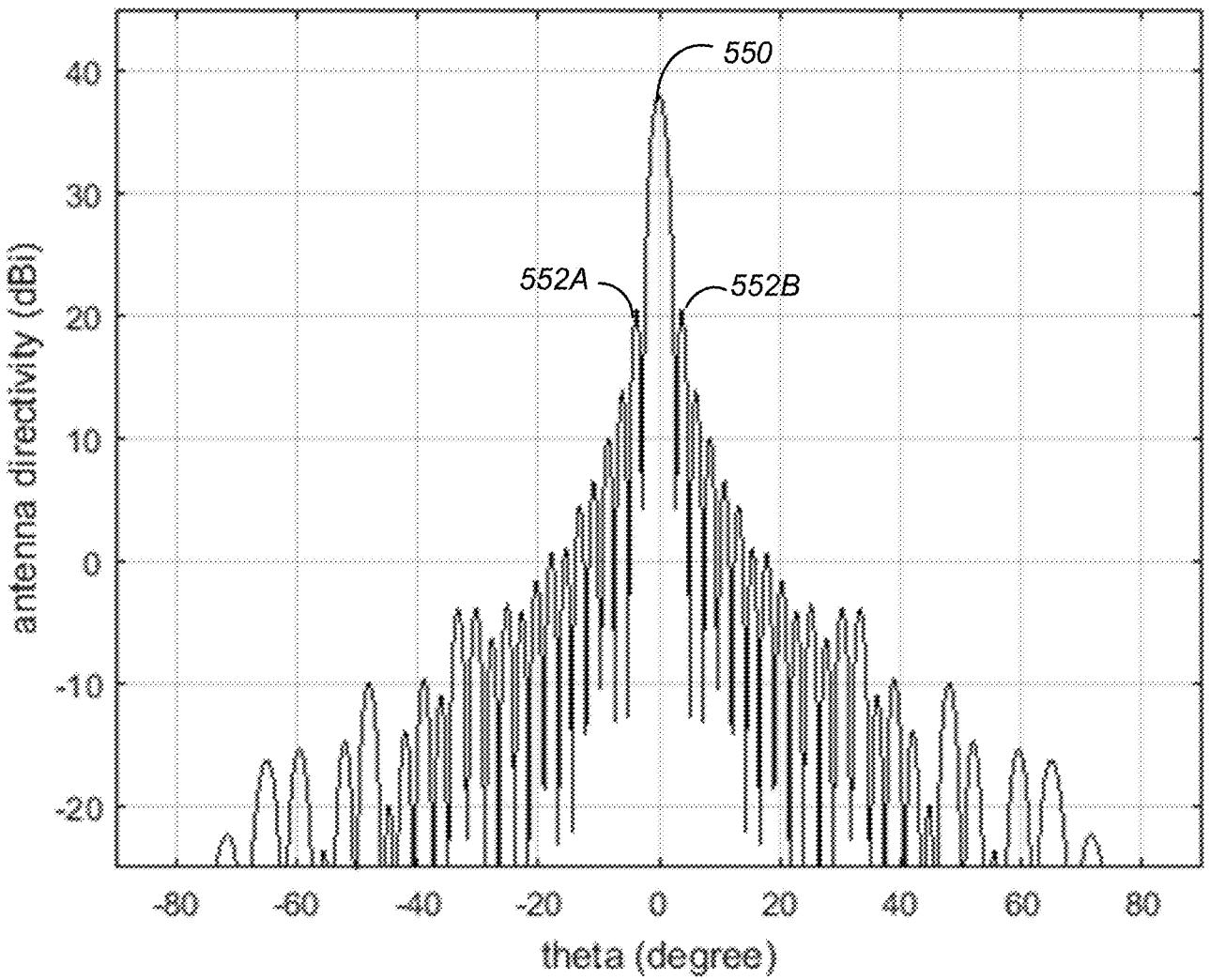

One possible solution to this problem is to activate only a subset of the radiating elements 212 of the active phased array antenna 208'. FIGS. 5A and 5B are diagrams illustrating characteristics of an active phased array antenna 208' in which only a subset 502 of the radiating elements 212 (and their associated TRMs 210) are active.

As illustrated in FIG. 5A, only 1888 of the radiating elements 212 (and/or their associated TRMs 210) are active. As illustrated, there are 3700 radiating elements in the array having a lattice of elements 0.215 inches apart in the horizontal direction and 0.186 inches apart in the vertical direction, with a skew of sixty degrees. However, only the subset 502 of the radiating elements are active.

In this embodiment, the subset 502 of radiating elements 212 are radiating elements 212 of the same density (e.g. the same number of radiating elements per unit area of the active phased array antenna 208') as the case illustrated in FIG. 4A, but with one or more of the dimensions of the active phased array antenna 208' reduced. In the illustrated example, the diameter of the subset of the radiating elements extends about 10 inches instead of the 14 inches illustrated in FIG. 4A. Because fewer radiating elements 212 are active, less heat is generated by the active phased array antenna 208, and the thermal dissipation of the active phased array antenna 208 is less than that of the situation depicted in FIG. 4A.

Figure 6A:
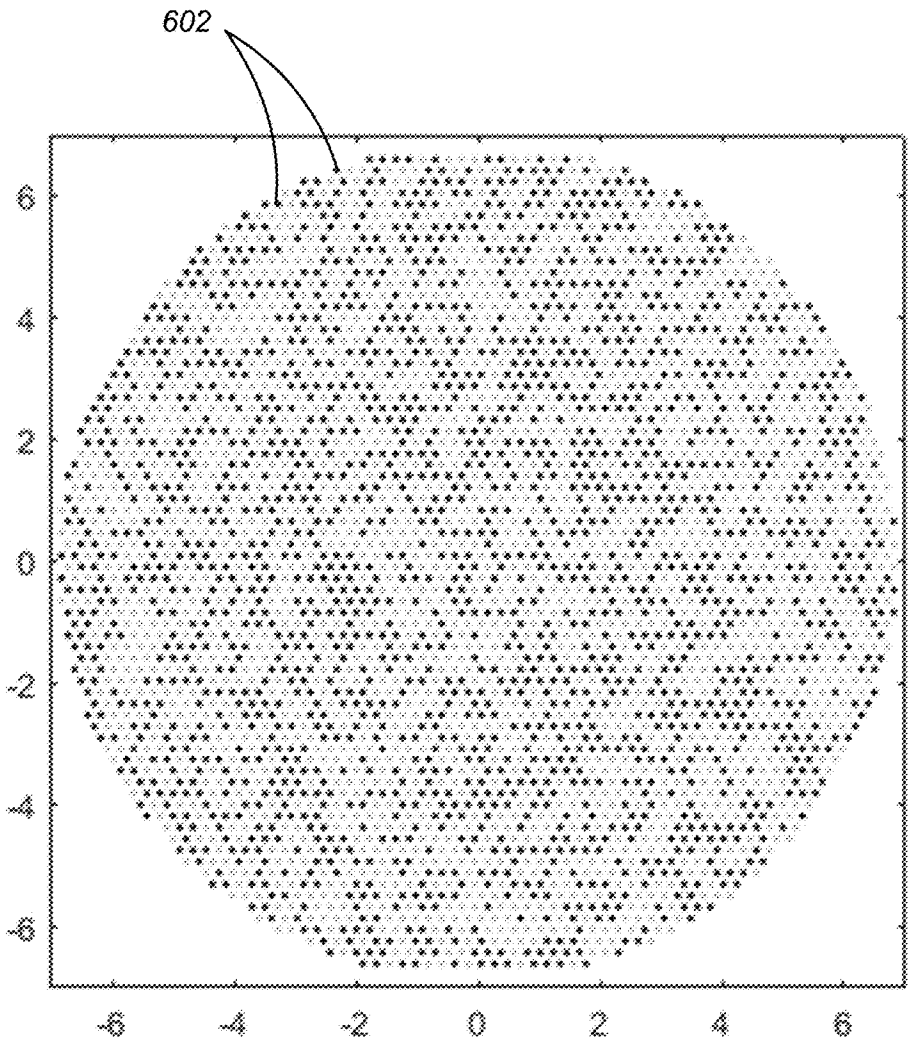
FIGS. 6A and 6B are diagrams illustrating characteristics of another embodiment active phased array antenna in which a thinned subset of the radiating elements are active.
Figure 6B:
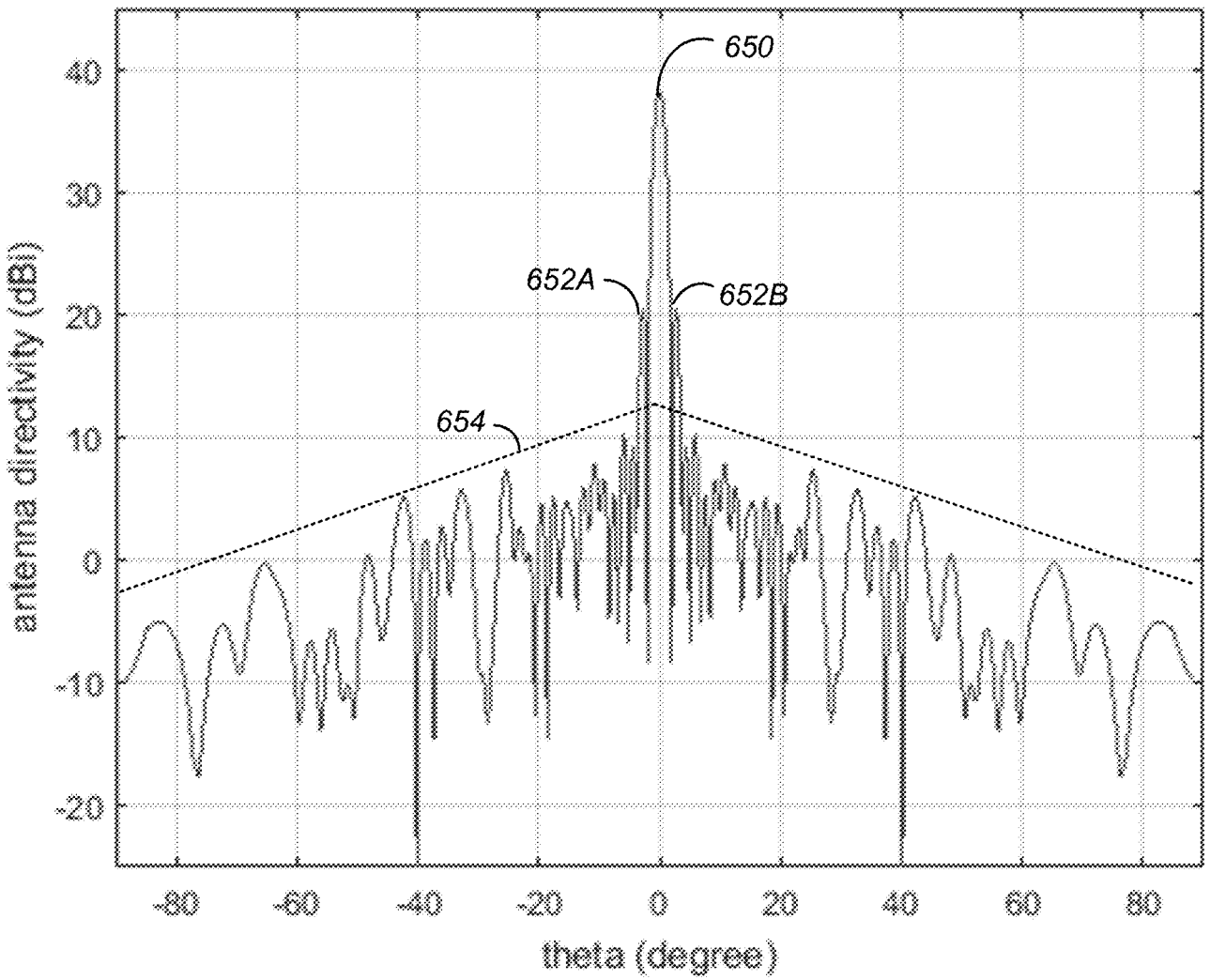

FIG. 5B is a diagram illustrating an antenna sensitivity pattern for the active phased array antenna 208" operating at 30.25 GHz with only the subset 502 of the radiating elements 212 shown in FIG. 5A in an active state. Note that the 3 dB beamwidth of the main lobe 550 has increased to almost 2.4 degrees. This broadened beamwidth increases the chance of creating interference with satellites nearby the satellite for which the communication is intended. For example, if the signal is intended for a target satellite and the apparent position of another satellite is within 1 degree of the target satellite, the signal intended for the target satellite represents an interference signal to the other satellite. Also, note that the sidelobes 552A and 552B are about 17 dB below the main lobe, and that the amplitude of the main lobe has decreased from approximately 40.8 dB to 37.9 dB FIGS. 6A and 6B are diagrams illustrating characteristics of another embodiment of the active phased array antenna 208 in which only a subset of the radiating elements 212 (and their associated TRMs 210) are active. However, unlike the case illustrated in FIGS. 5A and 5B, in this case, the subset 602 of radiating elements 212 are not chosen such that the radiating elements 212 in the subset 602 of radiating elements are not adjacent one another. Instead, each radiating element 212 of the subset 602 of radiating elements 212 is chosen such that the active radiating elements 212 are more uniformly disposed throughout active phased array antenna. In the illustrated embodiment, the subset 602 of the radiating elements 212 are pseudorandomly chosen so that the distance between each active radiating element 212 and adjacent active radiating element differs from radiating element 212 to radiating element 212. The result is that the subset 602 of active radiating elements 212 are of a substantially uniform density throughout the extent (14 inch diameter) of the active phased array antenna 208". Since fewer radiating elements 212 are active, the temperature and thermal density of the active phased array antenna 208" is reduced. However, because the active elements are chosen to be both uniform and to extend to the entire active phased array antenna, the resulting beamwidth of the main lobe is substantially the same as for the case depicted in FIG. 4A, in which all of the radiating elements 212 are active.

FIG. 6B is a diagram illustrating an antenna sensitivity pattern for the active phased array antenna 208" operating with only the subset 502 of the radiating elements 212 shown in FIG. 5A in an active state. Note that the beamwidth of the main lobe is approximately the same as the case where all of the radiating elements 212 are active (e.g. a 3 dB beamwidth of about 1.7 degree). This is expected, since the equivalent aperture of the active phased array antenna remains the same as the case presented in FIG. 4A, and the beamwidth of the main lobe is largely a function of aperture. Hence, the potential of this main lobe interfering with an adjacent satellite is about the same as is the case depicted in FIG. 4A, and less than that of the case depicted in FIG. 5A.

Further note that although there is substantial energy at the sidelobes, the sidelobes 652A and 652B adjacent the main lobe 650 are still approximately 17 dB below the main lobe 650, and hence, do not increase the potential for interference with adjacent satellites. Hence, this selecting the radiating elements 212 such that they are substantially uniformly and randomly dispersed throughout the active phased array antenna 208' provides for reduced thermal density, without sacrificing the beamwidth of the main lobe or the amplitude of the sidelobes adjacent the main lobe.

While the choice of the activated radiating elements 212 to be randomly dispersed throughout the extent of the active phased array antenna has benefits in terms of providing thermal management while maintaining the beamwidth of the main lobe and the amplitude of nearby sidelobes, it also has the disadvantage of increasing the energy in the sidelobes more distant from the main lobe. In particular, the amplitude of the sidelobes having an off-boresight angle greater than 10 degrees is larger than in the cases depicted in FIG. 4A or FIG. 5A. However, the amplitude of these sidelobes is sufficiently below the threshold required to assure adequate levels of interference suppression, and the pseudo random or non-uniform distance between active radiating elements 212 smooths out the sensitivity curve for those off-boresight angles, further reducing interference.

Figure 7:
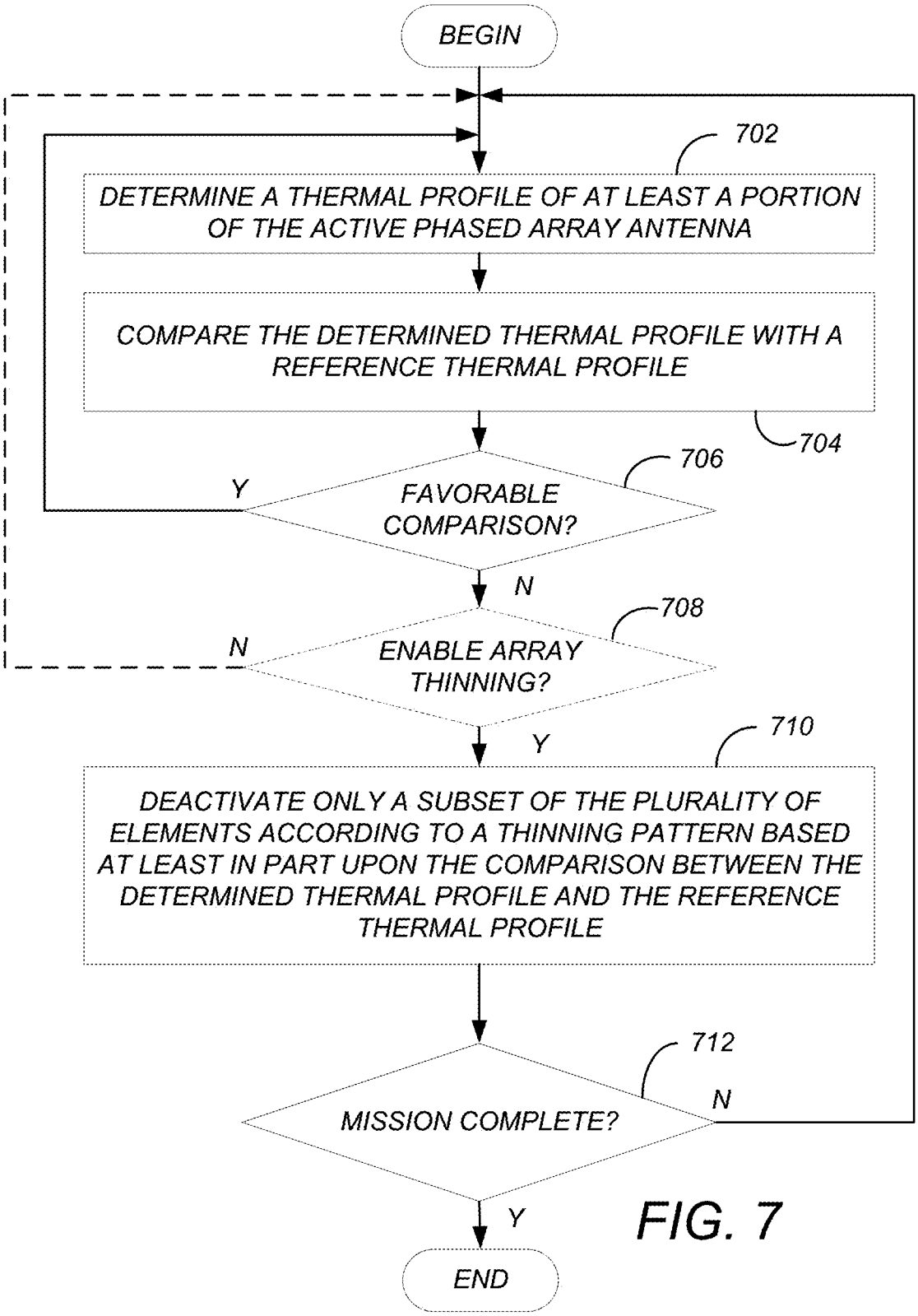
FIG. 7 is a diagram illustrating exemplary operations that can be performed to adaptively control the active phased array antenna having the plurality of radiating elements.

FIG. 7 is a diagram illustrating exemplary operations that can be performed to adaptively control the active phased array antenna 208" having the plurality of radiating elements 212. FIG. 7 is discussed with further reference to FIGS. 8A and 8B, which are diagrams that illustrates an exemplary embodiment of an adaptive array thinning system 800 for adaptively controlling an active phased array antenna 208' having the plurality of radiating elements 212.

Figure 8A:
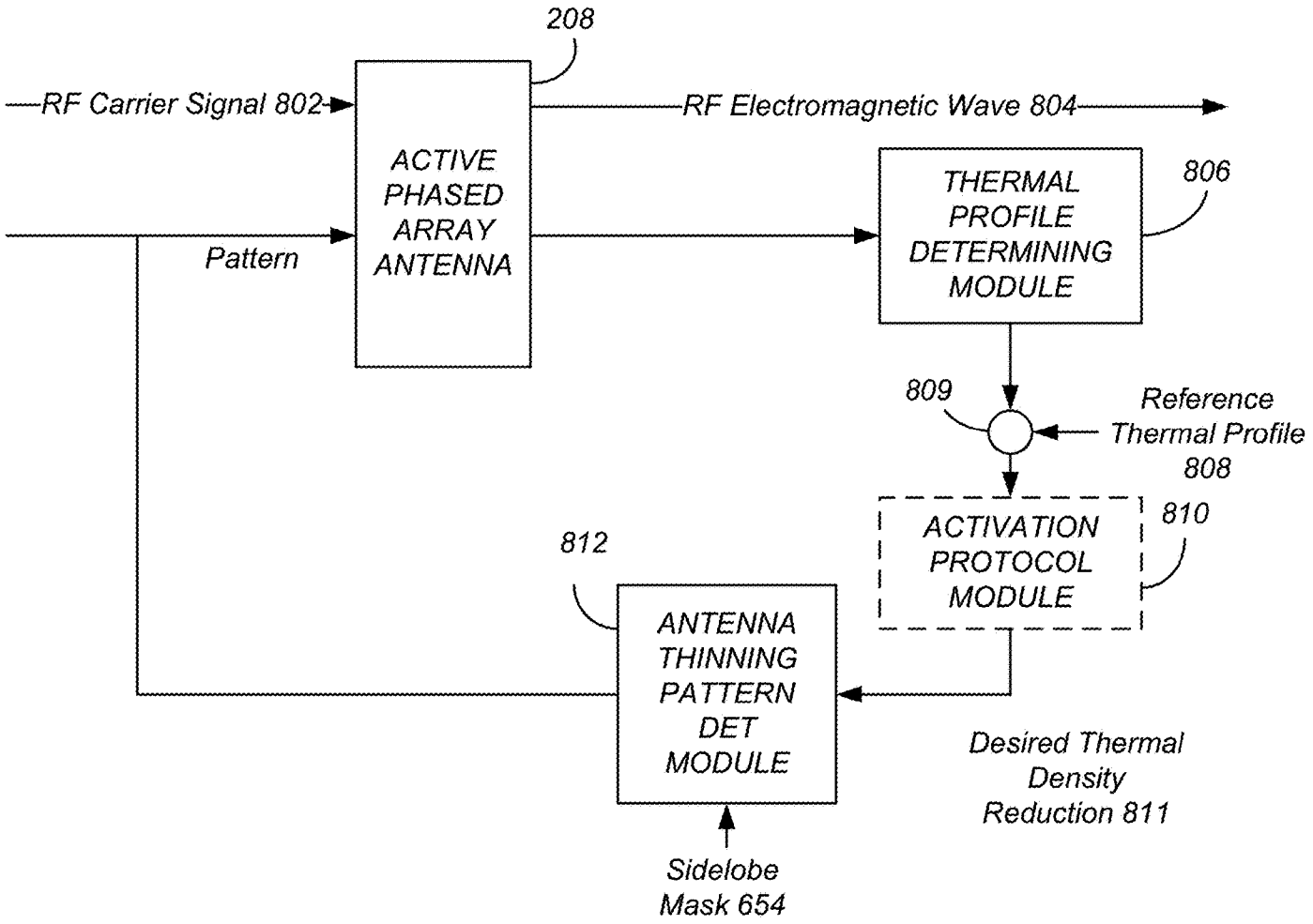
FIGS. 8A and 8B are diagrams that illustrates an exemplary embodiment of an adaptive array thinning system for adaptively controlling an active phased array having the plurality of radiating elements.

Referring first to FIG. 8A, an RF carrier signal 802 is provided to the active phased array antenna 208". The active phased array antenna 208' converts this RF carrier signal 802 into an RF electromagnetic wave 804, which is received by one of the satellites 102 in the communication system 100. The active phased array antenna 208' is configured to transmit the RF electromagnetic wave 804 using an antenna pattern comprising either all of the radiating elements 212 of the active phased array antenna 208' or a selected subset of those radiating elements 212. Typically, initial transmission of the RF electromagnetic wave 804 is accomplished with all of the radiating elements 212, because the thermal inertia of the active phased array antenna 208' is such that it takes a period of time for the thermal profile of the active phased array antenna 208' to approach or exceed a reference thermal profile to the extent that damage to the active phased array antenna may occur. However, after such initial transmission of the RF electromagnetic wave 804, the thermal profile of the active phased array antenna 208' changes, with the thermal density or maximum temperature increasing as the active phased array antenna 208' is used.

In block 702, a thermal profile is determined for at least a portion of the active phased array antenna 208'. This can be accomplished, for example, by the thermal profile determining module 806.

In one embodiment, the determined thermal profile comprises a thermal density of at least a portion of the active phased array antenna 208'. The thermal density is determined by combining information from temperature sensors distributed in the antenna with a known thermal impedance characteristic for the antenna. In another embodiment, the thermal profile comprises a maximum temperature of the active phased array antenna 208', for example, the temperature associated with the hottest radiating element 212N and/or its associated TRM 210.

Either the thermal density or the maximum temperature may be determined, for example, by direct measurement of the associated portions of the active phased array antenna 208', or may be estimated from other parameters of the active phased array antenna 208' that can be measured or otherwise determined. For example, the thermal profile of any portion of the active phased array antenna may be determined at least in part from TRM 210' parameters such as the power consumption or commanded power of the TRMs 210' currently active.

Other parameters may also be useful in predicting the thermal profile of the active phased array antenna 208', including characteristics of the RF carrier signal 802, the ambient temperature in the vicinity of the active phased array antenna 208', the speed or airspeed of a vehicle upon which the active phased array antenna 208' is mounted. Such parameters may be provided to a model of thermal inertia and heat transfer of the active phased array antenna 208' and used to predict the thermal profile.

Returning to FIG. 7, the determined thermal profile is compared with a reference thermal profile 808, as shown in block 704. This can be performed comparator module 809. The reference thermal profile may represent a maximum thermal profile (e.g. maximum thermal density or maximum temperature), or may be set to a thermal profile less than the maximum thermal profile, thus triggering a thinning pattern that will cool the active phased array antenna 208' to assure the maximum thermal profile is not reached, preventing damage to the active phased array antenna 208 and extending its life.

The comparison is used to determine which of the radiating elements 212 and associated TRMs 210 should be activated. Block 706 checks to determine if the comparison performed in block 704 is favorable. If determined thermal profile compares favorably to the reference thermal profile (e.g. the determined thermal density of the active phased array antenna 208' is less than that of the reference profile), processing is routed back to block 702, and all of the radiating elements 212 and associated TRMs 210 may remain active. If, however, the determined thermal profile does not compare favorably to the reference thermal profile (e.g. the determined thermal density of the active phased array is equal to or greater than the reference thermal density), processing is routed to block 710. The difference between the determined thermal profile of the active phased array antenna 208' and the reference thermal profile represents a desired thermal profile reduction 811.

In block 710, only a subset of the plurality of radiating elements 212 are deactivated according to a thinning pattern based at least in part upon the comparison between the determined thermal profile and the reference thermal profile 808. In the embodiment illustrated in FIG. 8A, this is accomplished by the antenna thinning pattern determining module 812.

In one embodiment, the subset 602 of the plurality of radiating elements 212 that will be activated is computed in real time, and computed to dynamically select the optimal thinning pattern (which of the radiating elements 212 are to be deactivated to thin the active phased array antenna radiating elements 212) subject to optimization criteria and constraints. In one embodiment, the thinning pattern is selected to maximize on-axis equivalent isotropic radiated power (EIRP) subject to a beamwidth constraint, a peak sidelobe constraint, and an acceptable thermal profile for the active phased array antenna 218'. In another embodiment, the thinning pattern is optimized to maximize on-axis equivalent isotropic radiated power (EIRP) spectral density subject to an off-axis equivalent isotropic radiated power (EIRP) spectral density constraint and an acceptable thermal profile for the active phased array antenna 218'. Other optimization criteria and constraints may be used, for example, selecting a thinning pattern that results in an acceptable target thermal density subject to signal to noise ratio (SNR) and sidelobe amplitude constraints.

For example, a sidelobe mask (such as the sidelobe mask 654 illustrated in FIG. 6B may be defined according to maximum sidelobe energy. For example, the sidelobe mask 654 may defined such that sidelobe amplitudes or energy levels are at or below the threshold defined in the sidelobe mask 654, are known to not interference with other satellites 102. Different sidelobe masks 654 may be used for different applications, depending on the satellite 102 or satellite network 101 with which communications are desired. The sidelobe mask 654 may also depend on the frequency of the RF carrier signal 802.

In one embodiment, the optimization problem may be described as to optimize array element excitations to maximize on-axis operating EIRP spectral density (ESD) in a hot thermal environment subject to constraints on operating temperatures throughout the array and off-axis ESD. The operating temperatures at different points throughout the array are a function of the element excitations (power dissipations) and the environmental boundary conditions. The optimization problem is subject to the design constraint of the array antenna layout and the design variable of which array antenna elements to excite. The objective function is to maximize on-axis ESD in a hot thermal environment over operating RF frequencies and beam pointing range subject to the constraint that the array internal temperatures are less than or equal to their maximum allowed temperatures, and the off axis ESD is below the sidelobe mask 654.

In a simple embodiment, only on/off values for element excitation are considered, and search for global solution using a suitable solver (for example, a genetic algorithm, simulated annealing or particle swarm). Other more complex embodiments allow complex values for element excitations, and perform a constrained non-linear optimization subject to more complex constraints (for example, antenna pattern sidelobe or null levels over angular sub ranges, or limits on internal temperatures that vary for different locations on the array.)

Figure 8B:
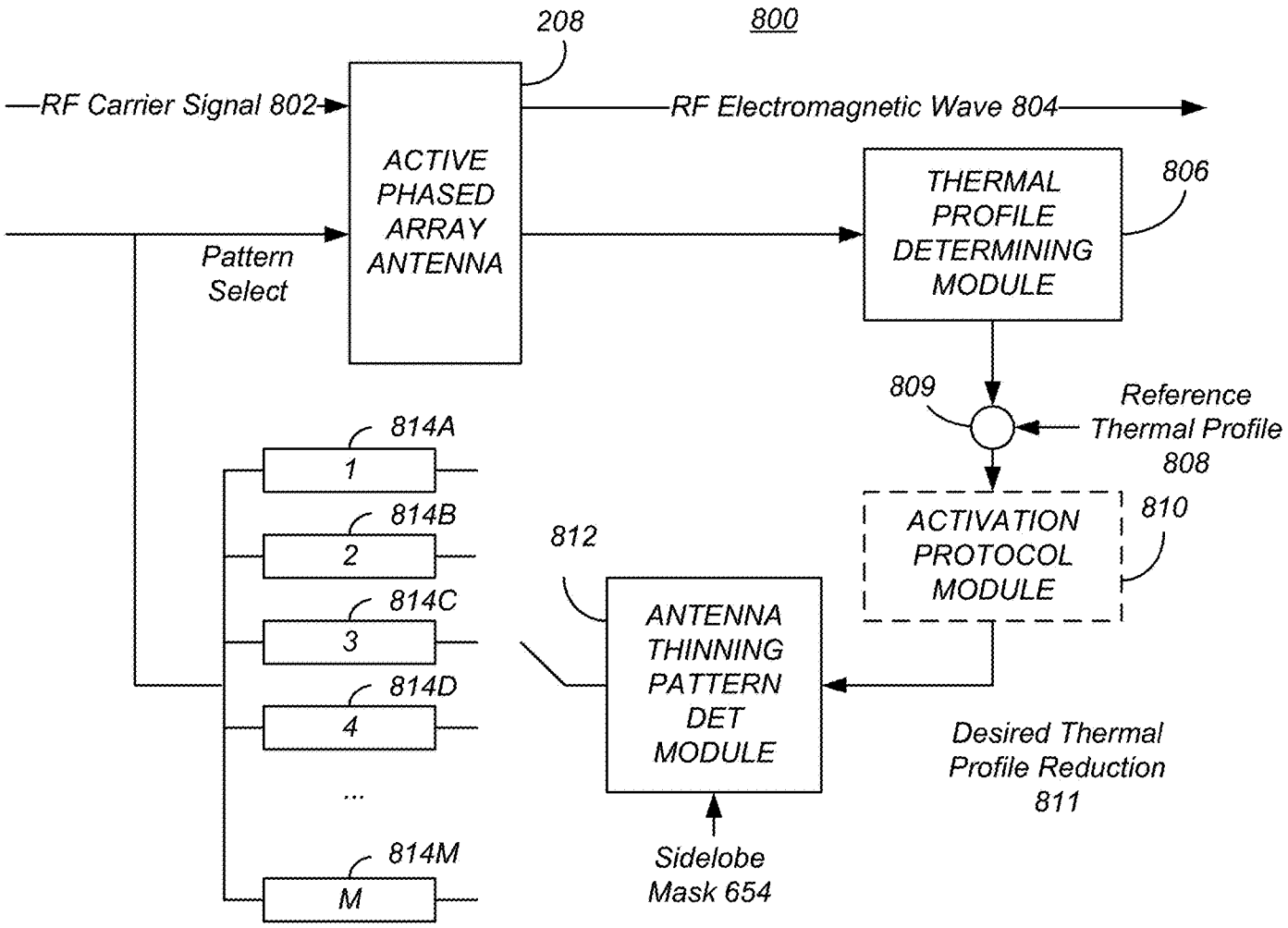

FIG. 8B is a diagram illustrating another embodiment in which the thinning pattern is selected from a group of pre-computed thinning patterns. In this embodiment, a plurality of different subsets 812A-812M of the radiating elements 212, each representing an antenna thinning pattern, are precomputed and selected by the antenna thinning pattern determining module 812. For example, a plurality of antenna thinning pattern or subset 814A may be precomputed for different particular sidelobe masks 654, SNR values, and desired thermal profile reductions 811. The antenna thinning pattern determining module 812 may then determine which of the precomputed thinning patterns 814A-814M best fits the desired thermal profile reduction 811, sidelobe mask 654 and SNR, and select that best thinning pattern 814A-814M.

FIGS. 7 and 8B also illustrate another embodiment in which put further limitations on when array thinning may be performed. Referring first to FIG. 7, block 708 determines whether array thinning is enabled. If array thinning is not enabled, processing is routed to block 702, whereas if array thinning is enabled, processing is routed to block 710 to perform array thinning by deactivating only a subset of the plurality of radiating elements 212. This embodiment allows the adaptive array thinning system 800 to respond only in circumstances warranting introduction of array thinning to reduce the thermal profile of the active phased array antenna 208'. This feature can be performed, for example, by the activation protocol module 810.

For example, the activation protocol module 810 may require that the thermal profile exceed a particular value or set of values by a particular amount or for a particular period of time (e.g. a trigger thermal profile), before triggering the antenna thinning pattern determining module 812 to compute and/or select a new thinning pattern. This prevents limit cycling behavior, in which the difference between the determined thermal profile and the reference thermal profile 808, while small, varies rapidly, causing a toggling between differing antenna thinning patterns in circumstances where it may be more appropriate to select a thinning pattern resulting in a lower thermal density and retaining this thinning pattern.

The activation protocol module 810 may also base the decision to activate antenna thinning based not only the difference between the reference thermal profile and the determined thermal profile, but also the rate at which the determined thermal profile is changing with time. Further, the reference thermal profile 808 can be set below a value which might damage the active phased array antenna 208', and the slope of the determined thermal profile examined to determine whether a different thinning profile needs to be computed or selected. This may provide the antenna thinning pattern determining module 812 additional time to determine a new thinning profile, particularly in embodiments wherein the new thinning profile is determined in real time rather than by selecting from a plurality of precomputed profiles.

Hardware Environment

Figure 9:
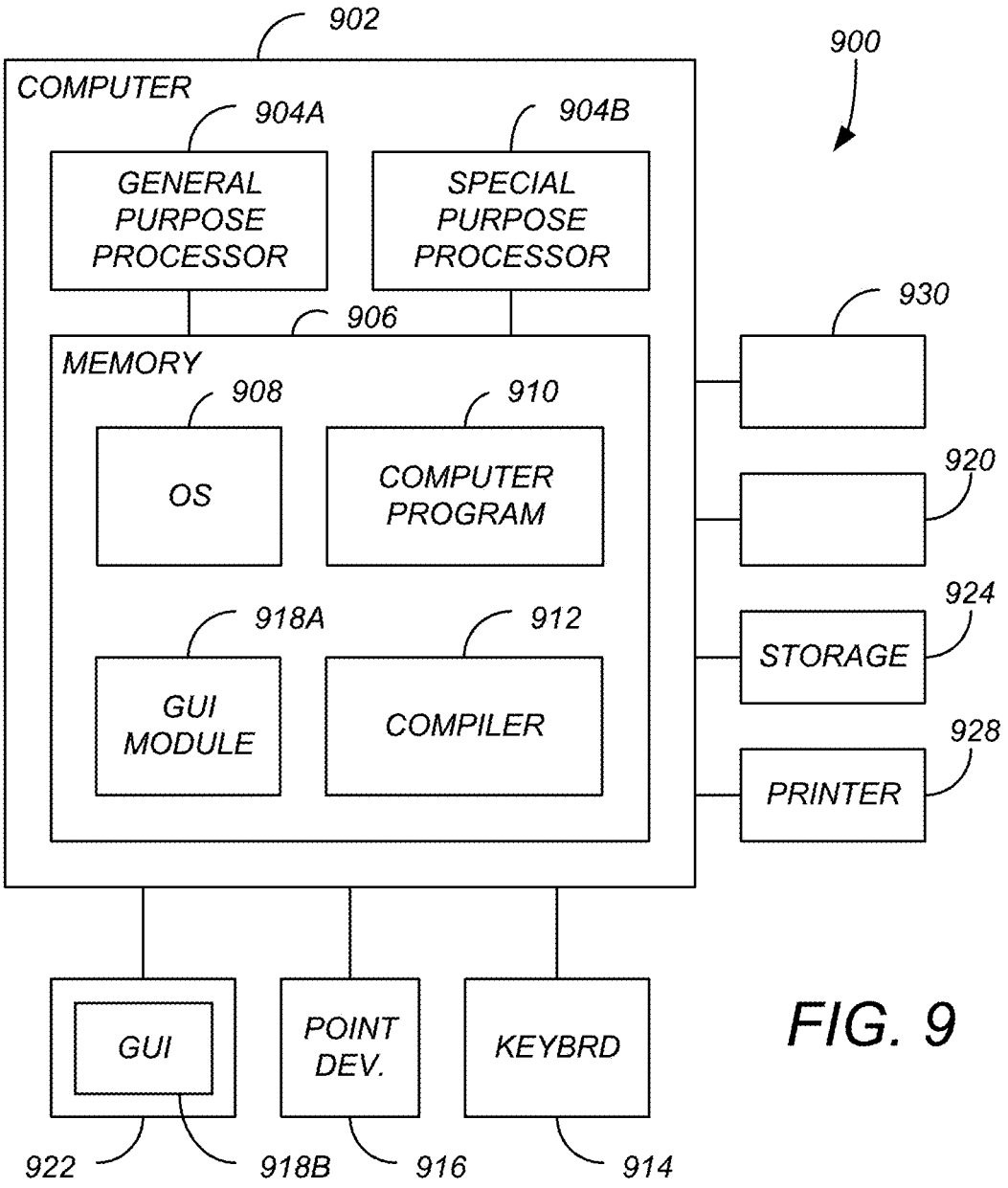
FIG. 9 illustrates an exemplary computer system that could be used to implement processing elements of the adaptive array thinning system.

FIG. 9 illustrates an exemplary computer system 900 that could be used to implement processing elements of the above disclosure, including the thermal profile determining module 806, the activation protocol module 810, the antenna thinning pattern determination module 812, the microprocessor 206. The computer 902 comprises a processor 904 and a memory, such as random access memory (RAM) 906. The computer 902 is operatively coupled to a display 922, which presents images such as windows to the user using a graphical user interface module 918B. The computer 902 may be coupled to other devices, such as a keyboard 914, a mouse device 916, a printer, etc. Of course, those skilled in the art will recognize that any combination of the above components, or any number of different components, peripherals, and other devices, may be used with the computer 902.

Generally, the computer 902 operates under control of an operating system 908 stored in the memory 906, and interfaces with the user to accept inputs and commands and to present results through a graphical user interface (GUI) module 918A. Although the GUI module 918B is depicted as a separate module, the instructions performing the GUI functions can be resident or distributed in the operating system 908, the computer program 910, or implemented with special purpose memory and processors. The computer 902 also implements a compiler 912 which allows an application computer program 910 written in a programming language such as COBOL, C++, FORTRAN, or other language to be translated into processor 904 readable code. After completion, the computer program 910 or application accesses and manipulates data stored in the memory 906 of the computer 902 using the relationships and logic that was generated using the compiler 912. The computer 902 also optionally comprises an external communication device such as a modem, satellite link, Ethernet card, or other device for communicating with other computers.

In one embodiment, instructions implementing the operating system 908, the computer program 910, and the compiler 912 are tangibly embodied in a computer-readable medium, e.g., data storage device 920, which could include one or more fixed or removable data storage devices, such as a zip drive, floppy disc drive 924, hard drive, CD-ROM drive, tape drive, etc. Further, the operating system 908 and the computer program 910 are comprised of instructions which, when read and executed by the computer 902, causes the computer 902 to perform the operations herein described. Computer program 910 and/or operating instructions may also be tangibly embodied in memory 906 and/or data communications devices 930, thereby making a computer program product or article of manufacture. As such, the terms "article of manufacture," "program storage device" and "computer program product" as used herein are intended to encompass a computer program accessible from any computer readable device or media.

Those skilled in the art will recognize many modifications may be made to this configuration without departing from the scope of the present disclosure. For example, those skilled in the art will recognize that any combination of the above components, or any number of different components, peripherals, and other devices, may be used.

Conclusion

This concludes the description of the preferred embodiments of the present disclosure.

The foregoing description of the preferred embodiment has been presented for the purposes of illustration and description. It is not intended to be exhaustive or to limit the disclosure to the precise form disclosed. Many modifications and variations are possible in light of the above teaching. It is intended that the scope of rights be limited not by this detailed description, but rather by the claims appended hereto.

What is claimed is:

1. A method of adaptively controlling an active phased array antenna comprising a plurality of radiating elements, comprising:

determining a thermal profile of at least a portion the active phased array antenna radiating elements;

comparing the determined thermal profile with a reference thermal profile; and deactivating only a subset of the plurality of the radiating elements according to a thinning pattern based at least in part on the comparison between the determined thermal profile and the reference thermal profile;

wherein the thinning pattern is substantially uniform throughout the active phased array antenna.

2. The method of claim 1, wherein the thermal profile comprises at least one of a thermal density of the at least a portion of the active phased array antenna radiating elements and a maximum temperature of the at least the portion of the active phased array antenna radiating elements.

3. The method of claim 1, wherein the thinning pattern maximizes on-axis equivalent isotropic radiated power (EIRP) subject to a beamwidth constraint and a peak sidelobe constraint.

4. The method of claim 1, wherein the thinning pattern maximizes on-axis equivalent isotropic radiated power (EIRP) spectral density subject to an off-axis equivalent isotropic radiated power (EIRP) spectral density constraint.

5. The method of claim 4, wherein deactivating a subset of the plurality of radiating elements according to a thinning pattern based at least in part on the comparison between the determined thermal profile and the reference thermal profile comprises:

generating a desired thermal profile reduction at least in part according to a difference between the determined thermal profile and the reference thermal profile; and determining a thinning pattern from the desired thermal profile reduction, the on-axis EIRP spectral density, and the off-axis EIRP spectral density constraint, wherein the off-axis EIRP spectral density constraint comprises sidelobe mask defining maximum sidelobe energy.

6. The method of claim 4, wherein:

the reference thermal profile is a maximum thermal profile.

7. The method of claim 4, wherein:

the reference thermal profile is a trigger thermal profile less than a maximum thermal profile.

8. The method of claim 1, wherein determining a thermal profile of the active phased array antenna comprises measuring a temperature of the active phased array antenna.

9. The method of claim 1, wherein determining a thermal profile of the active phased array antenna radiating elements comprises estimating a temperature of the active phased array antenna, the temperature estimated from one or more of:

a power consumption of a transmitter communicatively coupled to provide an input signal to the radiating elements of the active phased array antenna;

a commanded power to the transmitter;

ambient temperature proximate the active phased array antenna; and airspeed of the active phased array antenna.

10. The method of claim 1, wherein:

the thinning pattern is one of a plurality of pre-computed thinning patterns; and the thinning pattern is selected as one of the pre-computed thinning patterns.

11. The method of claim 1, wherein the thinning pattern is computed in real time.

12. An apparatus for adaptively controlling an active phased array antenna comprising a plurality of radiating elements, comprising:

a thermal profile determining module for determining a thermal profile of at least a portion the active phased array antenna radiating elements;

a comparison module for comparing the determined thermal profile with a reference thermal profile; and a thinning pattern determining module for deactivating only a subset of the plurality of radiating elements according to a thinning pattern based at least in part on the comparison between the determined thermal profile and the reference thermal profile;

wherein the thinning pattern is substantially uniform throughout the active phased array antenna.

13. The apparatus of claim 12, wherein the thermal profile comprises at least one of a thermal density of the at least a portion of the active phased array antenna and a maximum temperature of the active phased array antenna.

14. The apparatus of claim 12, wherein the thinning pattern determining module selects the thinning pattern that maximizes on-axis equivalent isotropic radiated power (EIRP) subject to a beamwidth constraint and a peak sidelobe constraint.

15. The apparatus of claim 12, wherein the thinning pattern determining module selects the thinning pattern that maximizes on-axis EIRP spectral density subject to an off-axis equivalent isotropic radiated power (EIRP) spectral density constraint.

16. An apparatus for adaptively controlling an active phased array antenna comprising a plurality of radiating elements, comprising:

means for determining a thermal profile of at least a portion of the active phased array antenna radiating elements;

means for comparing the determined thermal profile with a reference thermal profile; and means for deactivating only a subset of the plurality of radiating elements according to a thinning pattern based at least in part on the comparison between the determined thermal profile and the reference thermal profile;

wherein the thinning pattern is substantially uniform throughout the active phased array antenna.

* * * * *